US008339263B2

(12) United States Patent
Paananen et al.

(10) Patent No.: US 8,339,263 B2
(45) Date of Patent: Dec. 25, 2012

(54) SECURITY DEVICE FOR MONITORING INTEGRITY OF CLOSED OBJECTS

(75) Inventors: Jyrki Paananen, Hyvinkää (FI); Tuomas Martinkallio, Hyvinkää (FI); Timo Kivimäki, Helsinki (FI)

(73) Assignee: 4TS Finland Oy, Hyvinkaa (FI)

( * ) Notice: Subject to any disclaimer, the term of this patent is extended or adjusted under 35 U.S.C. 154(b) by 816 days.

(21) Appl. No.: 12/225,835

(22) PCT Filed: Mar. 23, 2007

(86) PCT No.: PCT/FI2007/000072

§ 371 (c)(1), (2), (4) Date: Aug. 1, 2009

(87) PCT Pub. No.: WO2007/110467

PCT Pub. Date: Oct. 4, 2007

(65) Prior Publication Data

US 2009/0295581 A1 Dec. 3, 2009

(30) Foreign Application Priority Data

Mar. 29, 2006 (WO) ..... PCT/FI2006/000098

(51) Int. Cl.
*G08B 13/14* (2006.01)

(52) U.S. Cl. ..... 340/572.1; 340/568.1

(58) Field of Classification Search ..... 340/572.1, 340/522, 566, 571, 568.1, 686.1
See application file for complete search history.

(56) References Cited

U.S. PATENT DOCUMENTS

| | | | | |
|---|---|---|---|---|
| 4,337,462 | A | 6/1982 | Lemelson | |
| 6,188,715 | B1 | 2/2001 | Partyka | |
| 6,529,144 | B1 * | 3/2003 | Nilsen et al. | 340/568.1 |
| 6,559,767 | B2 * | 5/2003 | Huang | 340/571 |
| 6,970,095 | B1 * | 11/2005 | Lee et al. | 340/568.1 |
| 7,113,091 | B2 * | 9/2006 | Script et al. | 340/522 |
| 2004/0100379 | A1 | 5/2004 | Boman et al. | |
| 2004/0233054 | A1 | 11/2004 | Neff et al. | |
| 2005/0040229 | A1 | 2/2005 | Andrews et al. | |
| 2005/0068177 | A1 | 3/2005 | Chun et al. | |
| 2005/0222933 | A1 | 10/2005 | Wesby | |

FOREIGN PATENT DOCUMENTS

| | | |
|---|---|---|
| EP | 1522981 | 4/2005 |
| RU | 93014132 | 3/1997 |

(Continued)

*Primary Examiner* — John A Tweel, Jr.
(74) *Attorney, Agent, or Firm* — Ware, Fressola, Van Der Sluys & Adolsphon LLP

(57) ABSTRACT

A security device (20) is a compact and inexpensive device for monitoring the integrity of closed objects that indicates when the state of a monitored condition inside the closed object has changed. The device (20) is small-sized so that it can also be placed inside small closed objects, e.g. a briefcase, box, envelope or alike, and that it is inconspicuous to the observer if the closed object is opened. The device (20) is relocatable inside the closed object. The device (20) comprises a controller (4) and associated memory (8), a time counter (6) in connection with the controller (4), sensors (2) communicating with the controller (4) and arranged to sense changes in conditions inside the closed object and indicating means (12) communicating with the controller (4) and arranged to wirelessly indicate invasion against the integrity of the closed object. While the changes in conditions inside the closed object comply with certain predefined conditions the alarm indication can be blocked. The alarm indication of the security device (20) can also be activated and deactivated externally by means of a remote control or automatically.

17 Claims, 4 Drawing Sheets

FOREIGN PATENT DOCUMENTS

| | | |
|---|---|---|
| RU | 2143742 | 12/1999 |
| RU | 2154305 | 8/2000 |
| RU | 27248 | 1/2003 |
| WO | WO 01/01363 | 1/2001 |
| WO | WO 02/077941 | 10/2002 |
| WO | WO 03/098908 | 11/2003 |
| WO | WO 2005/076238 | 8/2005 |
| WO | WO 2005/093677 | 10/2005 |

* cited by examiner

SECURITY DEVICE FOR MONITORING INTEGRITY OF CLOSED OBJECTS

CROSS REFERENCE TO RELATED APPLICATIONS

This application is the U.S. National Stage of International Application Number PCT/FI2007/000072 filed on Mar. 23, 2007 which was published in English on Oct. 4, 2007 under International Publication Number WO 2007/110467.

TECHNICAL FIELD OF THE INVENTION

The invention relates generally to a device for improving security, and more particularly to a device that monitors the integrity of closed objects and indicates invasion against the integrity.

BACKGROUND OF THE INVENTION

Most of today's security devices are designed to fit in buildings and vehicles, and such security devices are plug-ins to the mains current or powered by vehicle's battery to provide power to the components of the security devices. Therefore, there has been no need to optimise current consumption of such devices. Typical sensors used in these security devices are infrared and microwave detectors.

There are some portable security devices targeted for securing personal property items, which may be vulnerable to theft and vandalism. Such devices provide notification of disturbances to property items and tracking information regarding any movement of the property item. This kind of security device may be a module to be coupled to the cellular phone and then attached to property items like vehicles, trailers, bicycles, boats and home electronics. The power source of the cellular phone provides power to these security modules. Alternatively, the security device may be an integrated composition of security module and wireless transceiver, which composition is attached to property items described above. Rechargeable batteries or power sources are used to provide power to the components of these security devices. For tracking purposes the security device may be equipped with a tracking receiver or a receiver of the global position satellite (GPS) system.

Today's security devices are typically targeted to special applications, and they are usually fixed to the objects they are designed to protect. These kinds of security devices are rather expensive because they are not designed to be universal multi-purpose devices. Further, these security devices are so large in size that they are easily observed by potential offenders. When the device is the integrated composition of the security module and wireless transceiver, it is unusable in environments where radio frequency transmission is not allowed, e.g. aeroplanes in flight.

There is a need for a mobile, simple and inconspicuous device for monitoring integrity of a closed object, the object containing at least one item packed into it. The secure device should be easy and economical to produce and thus suitable for mass production, and the device is usable in a wide variety of applications to protect items in closed objects. The secure device should also be easy to place inside the closed object under monitoring. The term "mobile" means that the functionality of the device is independent of the place and movement of the closed object to be monitored.

The security device is designed to prevent theft, tampering, intrusion, adulteration or other such attempts on personal property items, chattels, goods and the like, which are packed into closed objects.

There is still a need for a simple and inconspicuous mobile security device for monitoring integrity inside a closed object, the security device comprising a wireless transmitter that can be switched off in totally safe conditions are dominant and/or in environments where radio frequency transmission is not allowed or possible. This allows more reliable operation of the security device by preventing unnecessary alarms, as well as savings in power consumption of the device. This is most beneficial in environments where extra interference is highly restricted or would be most unwanted.

SUMMARY OF THE INVENTION

Therefore, it is an object of the invention to provide a compact and inexpensive security device for monitoring the integrity of closed object and indicating if the state of a monitored condition inside the closed object has changed and/or eliminating indication if the monitored condition turns out to comply with certain prerequisites.

The object of the invention is achieved by providing a security device for monitoring changes in conditions inside a closed object, the device comprising sensor means arranged to sense changes in conditions of the closed object in successive time points and arranged to produce an alarm signal upon occurrence of such changes between successive time points, indicating means communicating with the sensor means, said indicating means arranged to indicate outside the closed object a presence of said alarm signal, wherein said sensor means is arranged to switch off said indicating means before indicating the presence of said alarm signal if the changes between successive time points comply with a certain reference condition.

In accordance with one aspect of the invention there is provided a device, wherein comparing means is arranged to compare sensed conditions between successive time points in order to produce the change detected and to compare the change detected with the reference condition.

In accordance with one preferred embodiment of the invention comparing means is arranged to compare sensed conditions in successive time points with the reference condition.

In accordance with another preferred embodiment of the invention indicating means comprises at least a wireless transmitter.

In accordance with another aspect of the invention there is provided a device, wherein indicating means further comprises input means arranged to receive an external command from outside, and arranged to activate and deactivate said indicating means in accordance with the external command.

In another preferred embodiment of the invention the input means comprises at least a wireless receiver arranged to receive the external command from an external wireless transmitter and arranged to be activated/deactivated according to said external command.

In still another preferred embodiment of the invention the indicating means comprises a wireless positioning transmitter arranged to transmit a position information indicating position of producing the alarm signal and/or indicating a position of the closed object.

The device is small-sized so that it can be placed inside small closed objects, e.g. a briefcase, box, envelope or alike, and that it is inconspicuous to the observer if the closed object is opened. The device is relocatable inside the closed object and thus it does not need any fixing arrangements to be attached to walls or covers of the closed object.

A benefit of the embodied invention provides a security device in which the alarm indication can be switched off in environments where the security of the monitored object is not at risk and the indication of the alarm may concern certain harm or the indication of alarm is not allowed for some reason e.g. due to radio frequency restrictions. Thus the security device according to the invention prevents indication of unnecessary alarms. It would also be beneficial to switch off indication of the security device in safe environments in order to save battery energy. A further benefit is that the security device according to the invention can be switched off either internally or externally.

In addition to above, a benefit of the embodied invention provides a solution in which the integrity of the closed object is monitored easily, reliably, unobserved and location-independently inside the closed object. Another benefit of the embodied invention provides a security device that is small in size, economical and suitable for mass production. Still another benefit of the embodied invention provides a standalone security device so that the functionality and movement of the device is independent of any external factor.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

An embodiment of the invention will be described in detail below, by way of example only, with reference to the accompanying drawings, of which

DETAILED DESCRIPTION OF THE INVENTION

Figure 1:
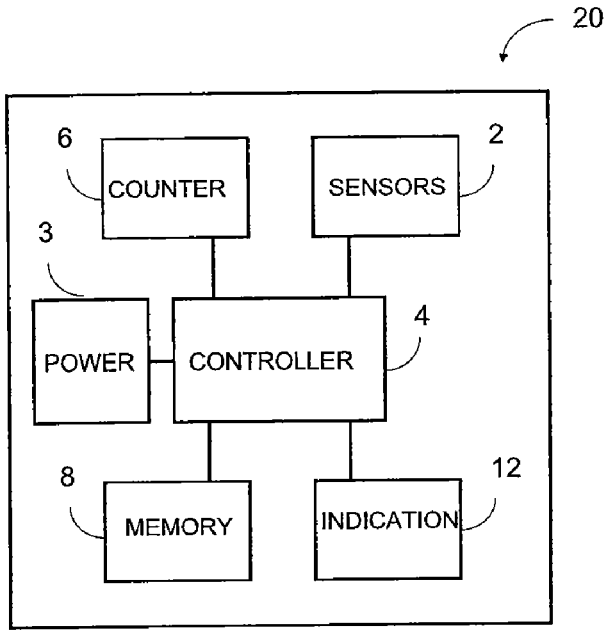
FIG. 1 depicts a block diagram of a device according to the invention.

A security device according to the invention is developed to the requirements of new operational environments. As an example, there is a need for the security device when a company sends confidential items, such as drawings of prototypes, from one place to another. Then the consignor, the transport company as well as the consignee want to be sure that no one has read the drawings during transportation, i.e. the received transmission item is unbroken. This can be realised by disposing the security device inside the closed object, e.g. a briefcase, box, envelope or alike, which contains the confidential items to be transported. Then the device monitors changes in conditions inside the closed object and produces an alarm signal upon occurrence of such changes, e.g. if the closed object is opened or moved without a permission.

The security device according to the invention is inconspicuous and thus it will not be exposed to the potential intruder. The device detects the opening of the cover of the closed object, stores alarm and time of detection to the memory and indicates the alarm. Consequently, it would be easy to find out instantly or later at which stage of transportation the integrity of the closed object was violated. This will also help tracking the suspected intruder by restricting the group of suspected intruders to be smaller, and at best designating the offender directly. The alarm event and time of detection can be transmitted to the receiving unit. Also the alarm, time and position of detection of the intrusion can be transmitted to the receiving unit.

Sensor means according to the invention comprises at least one sensor that is used to monitor changes in conditions inside the closed object. Such sensor means may comprise for example an accelerator used to monitor changes in acceleration inside the closed object or of the closed object, a pressure sensor used to monitor changes in pressure inside the closed object or of the closed object, a light sensor used to monitor changes in light inside the closed object, etc. Also temperature and/or moisture sensors can be used to monitor changes in conditions inside the closed object.

There is also a possibility to add to the security device according to the invention multiple sensors to monitor changes in conditions inside the closed object or the closed object and produce one or multiple alarm signals upon occurrence of these changes. These changes may be related to light, temperature, moisture, pressure, acceleration and similar conditions. This is useful, for example, if transportation of electronic products or other such products have to occur at certain predefined conditions to ensure guarantee or functionality of the products under transportation. These sensors produce the alarm if the conditions of the transportation are e.g. too hot, cold, humid, over or under pressurized, or if too fast acceleration, slow down or stop occurs, etc.

The security device according to the invention is provided with sensor means arranged to switch off power of indicating means whenever certain predefined conditions occur inside the closed object or of the closed object. If the changes in conditions detected by the sensor means turn out to comply with certain reference conditions, the sensor means may instruct the indicating means, preferably a wireless transmitter, to be switched off so as to prevent sending an unnecessary alarm message from the security device. This situation may occur in certain as such safe conditions, such as during transportation e.g. in the aeroplane, or other safe environments.

According to the invention reference conditions refer to certain momentary or long term conditions and are calculated based on those observations. The reference condition may refer to a value detected or derivation of the value detected (e.g. difference between detected values, etc.) to have a certain value, to be within limit values, to exceed or be below a certain value.

In the following there are listed requirements that the security device according to the invention has to fulfil. The device is capable of operation for several days, and the optimal operation time should be two weeks. The device is capable of moving across borders of countries and continents. The security device is capable of functioning and moving independent of any external factor so that it is a standalone device. The device is capable of maintaining operation while holding still and moving with pedestrian, bicycle, motorbike, car, train, ship, airplane or other such vehicle. The device is small in size so that it is inconspicuous while the closed object is opened. The device is capable of powering itself. As a result of these requirements the security device has low current consumption, small physical size and low supply voltage. According to the invention power consumption is also reduced by preventing unnecessary alarm indication in safe environments. Due to low power consumption the spurious radiation of the device remains low. As a consequence of all these features the device is simple in operation and therefore component count of the device remains low, and therefore may have low manufacturing expenses and mass production potentiality.

In addition to above, the security device is resistant to violent changes in temperature and humidity, as well as resistant to shocks, vibrations, falls and slams. This puts high standard requirements for manufacturing process and may lift the manufacturing expenses a bit.

FIG. 1 depicts a block diagram of the security device 20 according to the invention. A controller 4 controls other main blocks of the device 20. As an example, the controller 4 may be a typical commercially available microcontroller or microprocessor comprising a central processing unit (CPU), input-output (I/O) capacity for simple associated functions and memory 8. The memory 8 can be either internal microcontroller memory and/or external memory as known by the skilled person. The I/O capacity of the controller 4 comprises two I/O-buses for a computer (not shown), one of which is for programming and the other for reading the memory 8. The counter unit 6 can be included in the controller 4 or it can be a discrete block 6. There is also needed I/O connection to the sensor unit 2 and to the indication unit 12 as shown in FIG. 1. The security device 20 is a standalone device and it is powered from internal power source 3, which typically is a rechargeable battery, super capacitor or other lightweight power source.

According to an embodiment of the invention, the blocks of the security device 20 depicted in FIG. 1 are implemented to a single printed circuit board (PCB). According to another embodiment of the invention, the security device 20 is implemented as an embedded system on a single printed circuit board (PCB). A connector (not shown) should be mounted on the PCB for connecting the computer to the device 20 to program the controller 4 and to read the memory 8 of the device 20.

The sensor unit 2 comprises a detector that monitors an alarm loop. When the alarm loop is closed, the security device 20 is in sleep mode. When the alarm loop is opened, the security device 20 monitors a change in the alarm loop. As an example, when the closed object containing the security device 20 is at least partly opened the device 20 monitors the change in resistance of the alarm loop. The same follows if the alarm loop is broken, e.g. by cutting conducting wires of the loop. When the alarm loop is broken for any reason the sensor unit 2 sends an alarm signal to the controller 4 for processing it further. Optionally, there is arranged an A/D converter between the controller 4 and sensor unit 2. The sensor unit 2 is connected via the controller 4 to the indication means 12.

The sensor unit 2 comprises at least one sensor arranged to sense conditions inside the closed object after certain time intervals. According to one embodiment a single sensor is arranged to sense conditions inside the closed object and to switch off the indicating means 12 before indicating the presence of alarm signal if sensed condition or change in condition comply with said reference condition. According to another embodiment one sensor is arranged to sense conditions inside the closed object and another sensor is arranged to sense conditions inside the closed object or of the closed object and to switch off the indicating means 12 before indication the presence of alarm signal if sensed condition or change in condition comply with said reference condition. Exemplary, the sensor unit 2 may comprise a single accelerator or pressure sensor, etc., or it comprises a light sensor and accelerator or pressure sensor or any other similar detector.

According to an embodiment of the invention the device 20 comprises a comparing module means) formed by, for example, controller 4 and memory (with program code) 8 arranged to compare sensed conditions between successive time points. The comparing means 4, 8 are further arranged to compare a single sensed condition to a predetermined reference condition. The comparing means 4, 8 are further arranged to compare sensed conditions between successive time points in order to produce a change, e.g. difference, detected. Further the comparing means 4, 8 are arranged to compare the produced change, e.g. difference, to a predetermined reference condition.

The counter 6 is arranged to count time after a starting point is given, e.g. by resetting or programming the counter 6. In case of the alarm signal is derived from the sensor 2 to the controller 4, the controller 4 requests a time of alarm from the counter 6 and stores the time of alarm to the memory 8. Software programme of the controller 4 executes the counting of time and the storing of the time of alarm. Typically, the counter 6 is arranged to count real time, i.e. clock time. When the computer is connected the security device 20 and thus to the controller 4 to reset the time of the counter 6, the counting of time of the device 20 is cleared immediately in order to prevent defraud monitoring by setting false time. All programmed resets of the counter 6 or manual resets of the counter 6 if a reset button (not shown) is arranged to the device 20 are stored to the memory 8 associated with time of reset.

The indication unit 12 is arranged to indicate that the alarm signal is generated in the sensor unit 2. The sensor unit 2 is connected via the controller 4 to the indication means 12. The indication unit 12 comprises an alarm indicator that indicates the presence of the alarm signal at the sensor unit 2 wirelessly to the observer. The alarm indicator may be turned on immediately or delayed by a certain period of time after the presence of the alarm signal. The indicating functionality of the alarm indicator is organised by the computer programme. The indication unit 12 may also comprise an indicator of operation, e.g. a light emitting diode (LED), beeper or alike, that indicates the security device 20 to be in operational state. When the power source 3, e.g. battery is inserted in its place, the indicator of operation is turned on for a certain period of time.

Figure 2:
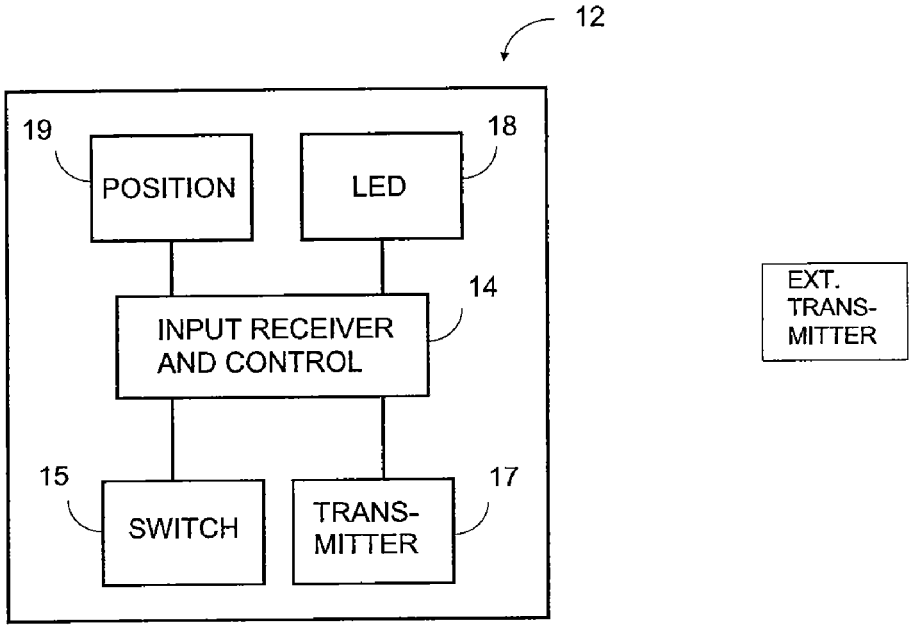
FIG. 2 depicts a more detailed block diagram of some embodiments of a device according to the invention.

FIG. 2 shows a more detailed block diagram of some embodiments of the indication unit 12 of the security device 20. The indication unit 12 comprises at least one alarm indicator 17, 18, 19 that indicates the presence of the alarm signal at the sensor unit 2 of the device 20 wirelessly to the observer. The alarm indicator 17, 18, 19 may be a RF transmitter 17 to indicate the presence of the alarm signal, a position detector/transmitter 19 to indicate a location of the security device 20 and/or indicator light 18 to indicate the presence of the alarm signal.

The indication unit 12 comprising a RF transmitter 17 may indicate the presence of the alarm signal by turning on the RF transmitter 17. The RF transmitter 17 is arranged to transmit the alarm signal and the observer can check the presence of the alarm signal by an appropriate RF receiver outside the closed object. The alarm indicator comprising an indicator light 18, e.g. a light emitted diode (LED) may indicate the presence of the alarm signal by turning on the indicator light 18. The observer can check the presence of the alarm signal whenever he desires to do so by opening the closed object and visually checking if the indicator light 18 is turned on or off. If there are present more than one alarm signal in the security device 20 then the indicator light 18 is arranged to blink. After checking the indicator light 18 the observer acknowledges the alarm. Alternatively, an infrared radiator, electromagnetic or magnetic radiator can be used as the alarm indicator that may be detected outside the closed object without opening the closed object by a suitable detector.

The indication unit 12 comprising a position detector/transmitter 19 may indicate a location of the security device 20. The observer may locate the position of the device 20 using an appropriate position receiver outside the closed object. The position transmitter 19 of the indication unit 12 can be arranged to indicate the location of the security device 20 at the presence of the alarm signal from the sensor unit 2. Then, in case of the alarm signal is derived from the sensor 2 to the controller 4, the controller 4 requests a location of alarm from the position detector/transmitter 19 and stores to the memory 8 the location of alarm together with the time of alarm from the counter 6. Satellite communication link between the position detector/transmitter 19 and satellites is arranged to comply any satellite communication protocol known to the skilled person, e.g. Global Positioning System (GPS). Alternatively, also GSM based systems provided with RF transmitter 17 can be used to indicate the location of the security device 20. Also a combination of the GPS and GSM systems can be used to indicate the location of the security device 20. In addition to the position detector/transmitter 19 the indication unit 12 may comprise the RF transmitter 17 and the indicator light 18. Then, the presence of the alarm signal is indicated both by transmitting it from the RF transmitter 17 and by turning on the indicator light 18, also the location of alarm is transmitted by the RF transmitter 17.

According to an embodiment of the invention certain reference condition is predetermined such that if such reference condition is met as a result of comparing the indication of alarm is blocked, as earlier explained. The sensor unit 2 in combination with the comparing means comprising at least controller 4 and memory 8 is arranged to switch off the at least one alarm indicator 17, 18, 19 of the indication unit 12 if the conditions sensed and/or changes sensed comply with said certain reference condition. Consequently, the at least one alarm indicator 17, 18, 19 is arranged to block transmission of the alarm signal outside the closed object. In this way the alarm indicators 17, 18, 19 are switched off internally without any external command.

Optionally, as shown in FIG. 2, there is connected an input device 14 to the alarm indicator 17, 18, 19 to receive an external command to control the operation of the alarm indicator 17, 18, 19. An appropriate input device 14 connected to the alarm indicator 17, 18, 19 may allow switching on and off the alarm indicator externally. External switching of the alarm indicator 17, 18, 19 may depend on certain reference condition or can take place independent of the reference condition.

Exemplary, the input device 14 may comprise a RF receiver to receive an external command to control the operation of the RF transmitter 17. Preferably, the RF receiver of the input device 14 is arranged to switch off and on the RF transmitter 17 according to the external command. The external command is received from an appropriate RF transmitter disposed outside the closed object. RF communication link between RF transmitter 17 and the appropriate external RF receiver, as well as between the RF receiver of the input device 14 and the appropriate external RF transmitter, is arranged to comply any RF communication protocol known to the skilled person. Such protocols include wireless terrestrial and satellite RF systems, e.g. GSM, CDMA, Inmarsat, Iridium or other system, as well as short-range wireless RF systems, e.g. Bluetooth. The RF transmitter 17 is arranged to operate preferably in at least two different frequency bands. According to one embodiment of the invention, in addition to the RF transmitter 17, the indication unit 12 comprises also the indicator light 18. Then, the presence of the alarm signal is indicated both by transmitting it from the RF transmitter 17 and by turning on the indicator light 18.

Optionally, there is arranged a switch 15 that is accessible outside the security device 20 to switch off the alarm indicator 17, 18, 19. According to an embodiment the switch 15 is arranged to be the input device 14. The switch 15 may be any switch known to the skilled person to be switched off by responding to mechanical, optical, magnetic or electric stimulus. After checking the alarm indicator 17, 18, 19 the observer acknowledges the alarm by pressing the switch 15 of the device 20. Alternatively, the input device 14 is an optical receiver arranged to receive infrared impulse and to command the switch 15 to be switched off or on. Or the input device 14 is an electromagnetic or magnetic receiver arranged to receive electro-magnetic or magnetic impulse and to command the switch 15 to be switched off or on.

The external command received by the input device 14 of the indication unit 12 can be a command to shut down or turn on all RF parts of the device 20 including the RF transmitter 17, the RF receiver of the input device 12, the position detector/transmitter 19. The external command can also be a command to shut down all radiating parts of the device 20 including infrared radiator, magnetic radiator or such indicator light 18. The external command can also be a press of key switch 15 to turn off the LED 18. The external command may be a command from a remote control unit or it may be arranged, e.g. programmed, to execute automatically. The external command is typically received outside the closed object from the appropriate external transmitter. The shut down feature is useful for example in airports where the external transmitter is arranged to shut down all RF or radiating parts of the security device 20 for air transportation due to aviation regulations, and on the other hand after the air transportation RF or radiating parts of the security device 20 are activated again from the external transmitter. The shut down and turn on feature may be applied also in other applications, e.g. automatically in doorsteps of warehouses or similar places where the external transmitters are disposed. One possibility to arrange the external command is to "paint" or "colour" a certain wireless cell of the cellular system in such a way that all RF parts are shut down when the security device 20 enters into the range of such cell, and activated when the security device 20 leaves the range of such cell, or vice versa. Another possibility is to arrange a RFID tag to the input device 14 of the security device 20 and a RFID antenna to the appropriate location so that when the RFID tag passes through a magnetic field induced by the RFID antenna, the RF parts of the security device 20 are either deactivated or activated. The appropriate location may be for example the gate of the airport, the doorstep of the warehouse, the barrier of the road or any such place. Still another possibility is to shut down and turn on the radiating parts of the security device 20 mechanically by pressing the switch 15.

Figure 3:
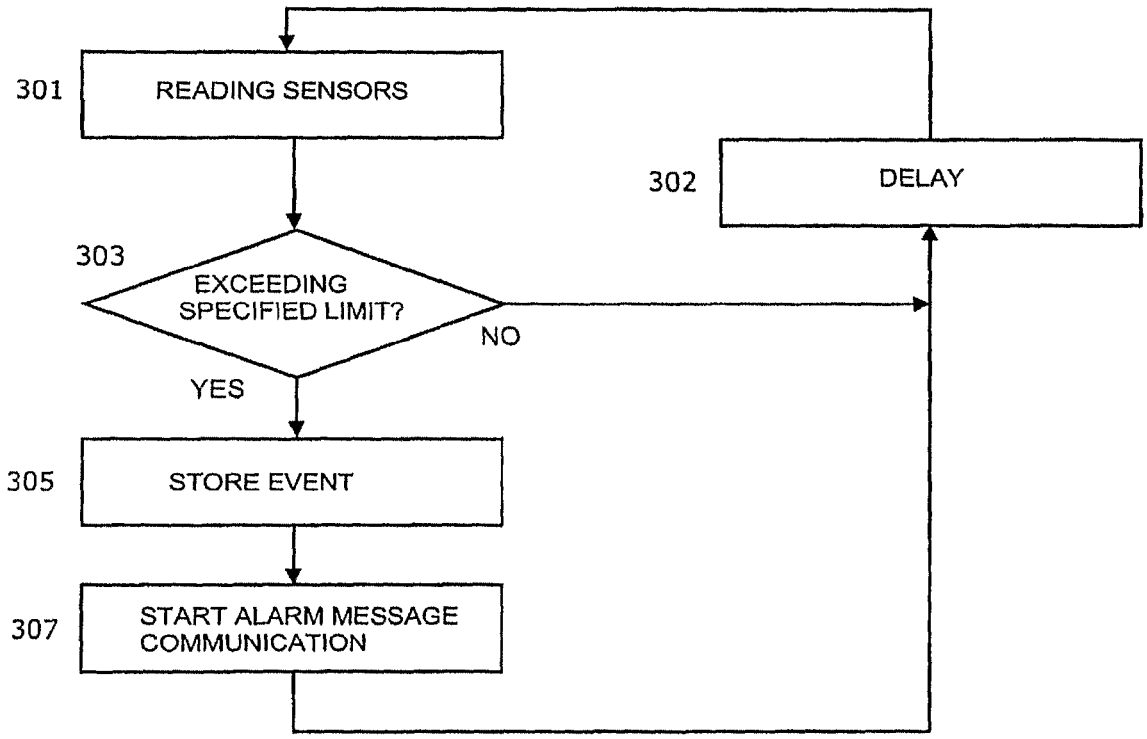
FIG. 3 depicts a flow diagram of general functionality of a security device.

FIG. 3 depicts a flow diagram of basic functionality of the security device 20 according to an embodiment of the invention while performing "normal" monitoring function in any environment. After sensors are read in step 301 comparing means 4, 8 is arranged to compare sensed conditions between successive time points, i.e. changes, or single sensed conditions to certain specified limit, e.g. threshold value, according to step 303. If specified limit is not exceeded sensors are read again after a certain time interval defined in step 302. But if the conditions sensed an/or changes sensed exceeds the specified value, this alarm event is registered to the memory 8 of the device 20 in step 305, as explained in association with FIG. 4. Consequently an alarm message is generated by the sensor means 2 and transmitted to the indicating means 12. Further embodiments describing further steps are depicted in FIGS. 4 and 5 more detail.

Figure 4:
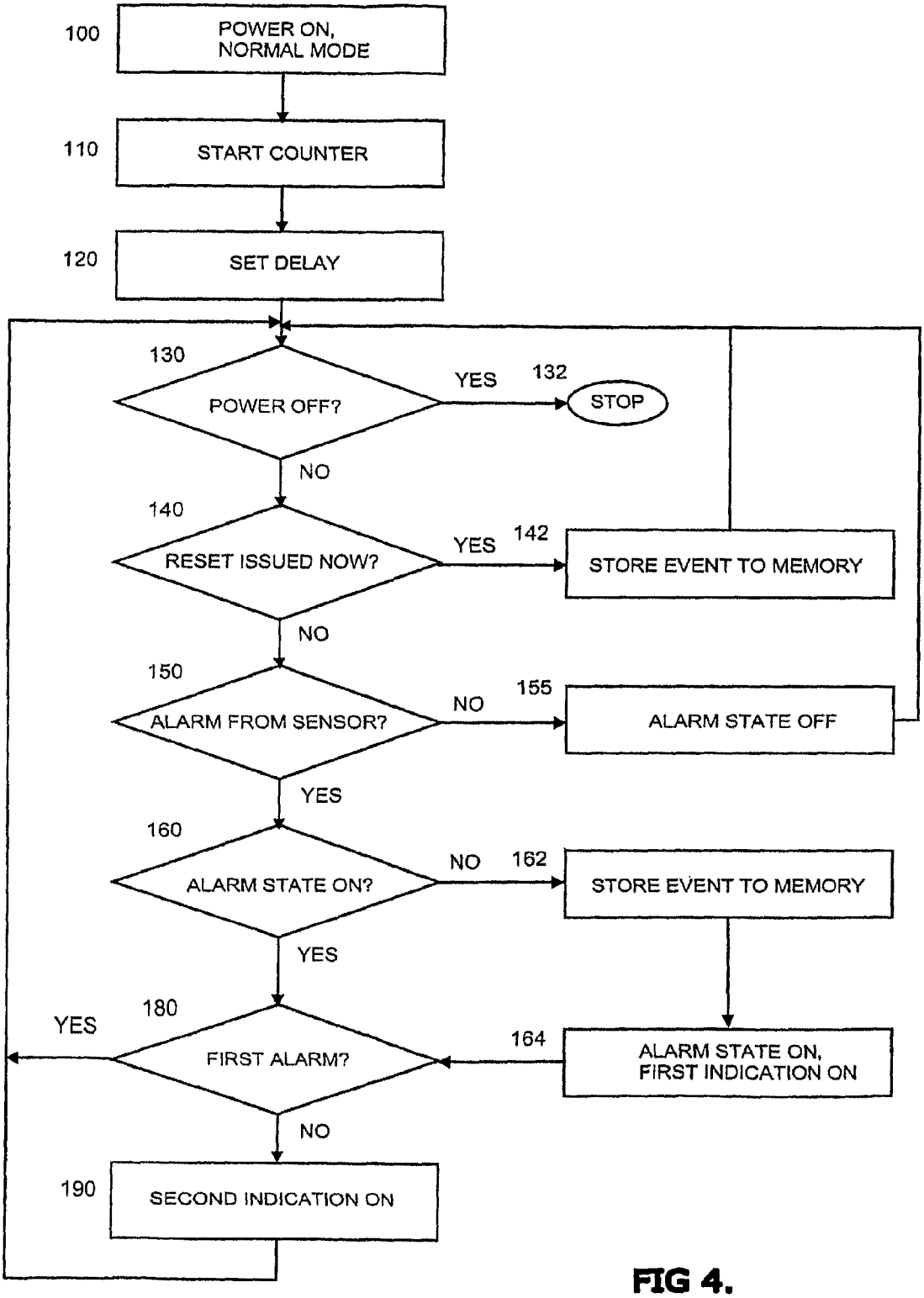
FIG. 4 depicts a flow diagram of functionality of a security device according to an embodiment of the invention.

FIG. 4 depicts a flow diagram of functionality of the security device 20 according to exemplary embodiment of the invention. The power of the security device 20 is switched on when the power source 3, e.g. battery is installed, as shown in step 100. The device 20 operates now in the normal mode. At the moment the device is switched on the counter 6 start running according to step 110. If desired in the next step 120 the device 20 can be set to waiting state for a certain period of time. If the power source is not switched off in step 130, the security device 20 checks that the counter 6 has not been reset in step 140. If the counter 6 has been reset, then according to step 142 the reset event and corresponding time is stored to the memory 8. If the counter 6 has not been reset the controller 4 requests if an alarm signal from the sensor unit 2 is presented, as shown in step 150. If there is no alarm from the sensor unit 2 in step 150, the alarm state is set off in step 155 and the device 20 continues to monitor sensors. In case the presence of the alarm signal, the controller 4 checks if the alarm state is on according to step 160. Then the alarm event and time of alarm with possible position information are stored to the memory 8, as shown in step 162. The alarm event stored in step 162 is associated with the ordinal number 1 (i.e. first alarm). If the alarm state is not on in step 160, the alarm state is set on and the indicator 18 is turned on to indicate the alarm state, e.g. by constant indication, in step 164. If it is the first alarm in question in step 180 the device 20 continues to monitor sensors. If the alarm in question in step 180 is a second, third, etc. alarm, the indicator 18 is arranged to indicate the alarm by indication that differs from the indication of the first alarm, e.g. by blinking indication according to step 190. When the power is switched off the security device 20 it stops operation according to steps 130 and 132.

FIG. 4 shows exemplary the functionality of device 20 wherein light indicator 18 is presented as an alarm indicator. However, any transmitter 18, 19 can also be used instead of the light indicator 18 to indicate the presence of alarm signal as earlier described. In the embodiment of FIG. 4 the alarm indicators 17, 18, 19 can be switch off (and on) using an external command received by the input receiver 14 as described earlier as well. This is feasible in certain situations and environments as explained earlier. Alternatively, the alarm indicators 17, 18, 19 can be switch off (and on) internally when the sensor unit 2 in combination with the comparing means 2, 4 commands to switch off the alarm indicator 17, 18, 19 as described next.

Figure 5:
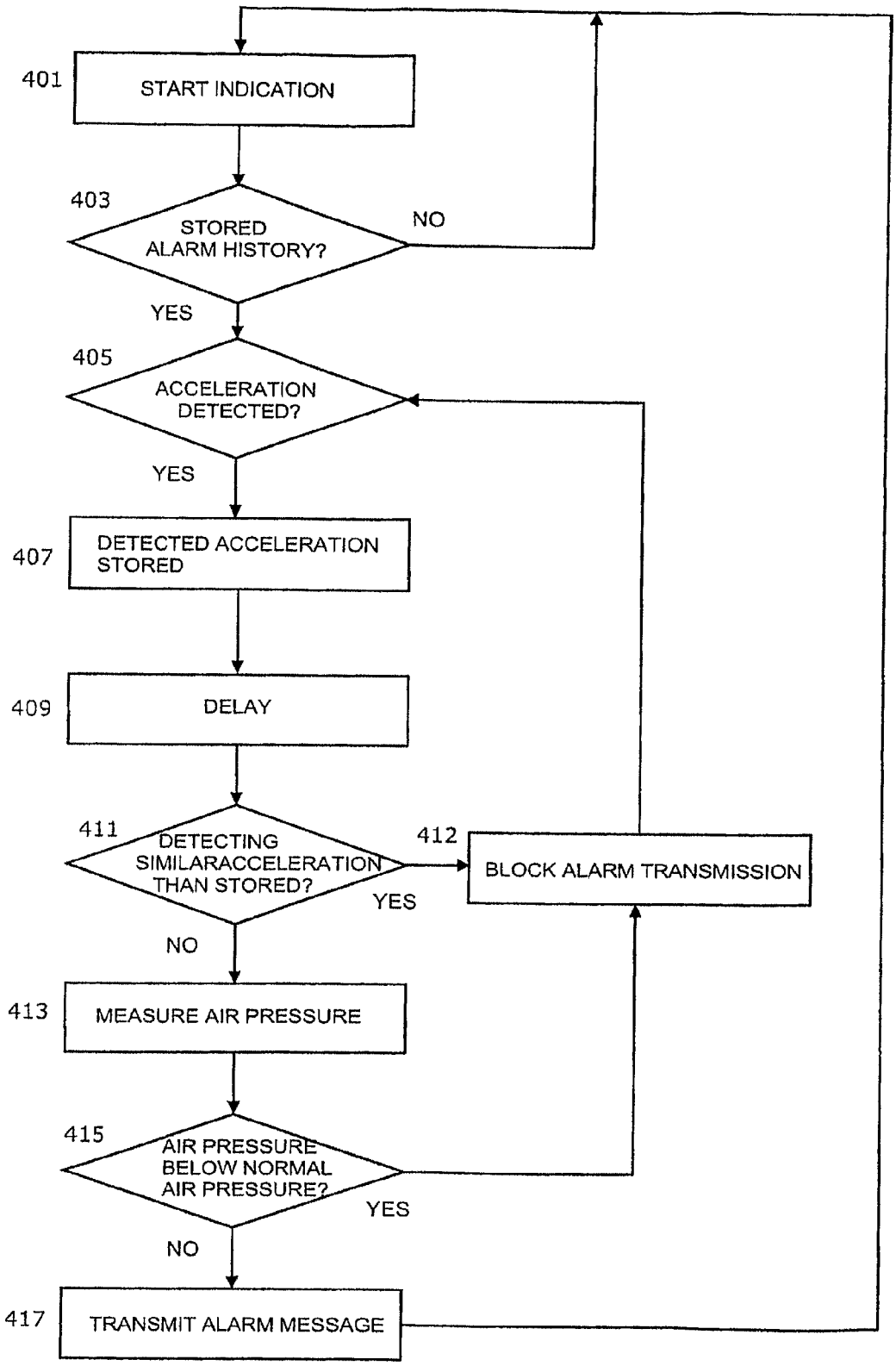
FIG. 5 depicts a flow diagram of functionality of a security device according to another embodiment of the invention.

FIG. 5 depicts a flow diagram of functionality of the security device 20 according to another embodiment of the invention. The step 401 start indication refers to the functionality of steps 307 of FIG. 3 and/or step 164 of FIG. 4, where the alarm state is on, i.e. the sensor unit 2 has produced an alarm signal and communication between the sensor unit 2 and the indication unit 12 concerning alarm occurs. In next step 403 it is checked whether one or more pre-existing alarm events have been stored in the memory 8. If there is not found any pre-existing alarm events the indication of alarm continues normally in step 401. However, if pre-existing alarm events occur in the memory 8 the procedure continues to step 405. In step 405 the sensed condition, e.g. acceleration of the closed object, is detected and a first value of the sensed condition is then stored to the memory 8 in step 407. According to an embodiment of the invention after a certain period of time defined in step 409 the sensed condition, e.g. acceleration of the closed object, is again detected in step 411 and a second value of the sensed condition is compared to the previous first value of the sensed condition, e.g. acceleration of the closed object. In step 411 the comparing means 4, 8 is further arranged to produce a change, e.g. difference, detected between successive time points, i.e. between the first and second value of the sensed condition and compare the produced change to the predetermined reference condition according to an embodiment of the invention. If the change detected in step 411 is within the limits of the reference condition the alarm transmission is blocked and the alarm indication is therefore switched off according to step 412. Then the procedure proceeds to step 405 again. If the change detected in step 411 is not within the limits of the reference condition then the sensor unit 2 is arranged to detect another condition in a single time point inside the closed object or of the closed object, which detected condition can concern the same condition as in step 405 or another condition, e.g. pressure, if the sensor unit 2 comprises multiple sensors. Next in step 415 the another detected condition is compared by the comparing means 4, 8 to a predetermined reference condition referring to single reference values, e.g. normal air pressure. The single value refers here to a value of the condition in a single time point. If in step 415 the another detected condition is below the single reference value, e.g. below the normal air pressure, the alarm transmission is blocked and the alarm indication is therefore switched off according to step 412. If in step 415 the another detected condition is not below the single reference value, e.g. below the normal air pressure, the alarm transmission is communicated to the indication unit 12 and the alarm indication is switched on or continued.

Above-mentioned two-step alarm detection procedure according to an embodiment of the invention is useful for example during transportation of the monitored closed objects in airplanes or any other environment that can be classified to be safe environment. As an example, during air transportation the detection of step 411 may concern changes in acceleration, i.e. if similar kind of acceleration is detected between time points, the security device 20 according to the invention draws a conclusion that the acceleration detected is typical for airplanes and therefore the closed object is in safe environment and the alarm indication is unnecessary. Further to be sure enough about the environmental safeness in step 415 another condition is detected, exemplary here the air pressure of the closed object is detected to make sure that the closed object is really disposed in the airplane. If both prerequisites (steps 411 and 415) are not fulfilled the alarm indication is activated, because the security device 20 draws a conclusion that the closed object exists in unsafe environment, i.e. it is e.g. not anymore under transportation in the airplane.

The security device 20 according to the invention can be used to monitor the integrity of stationary and moving closed objects. The use of the device 20 is very versatile because of the relocatable disposal of the device 20 inside the closed objects. Relocatable means that the device 20 does not need any fixing arrangements to be attached to walls or covers of the closed object, and it can be disposed so that it will be inconspicuous among the items inside the closed object. Relocatable also means that the device 20 may be set on top of the items or below the items and anywhere between the top and bottom of a plurality of items inside the object. The device 20 can even be thrown into the object containing items before closing the object. The closed object may contain a singular item or a plurality of items. The item can be any physical thing, e.g. document, cellular phone or any other thing, inside the closed object. One important field for using the security device 20 is freight and cargo transportation of goods which are closed in cases for transportation by air, by boat, by road, by rail, on foot, etc.

The sensor unit 2 of the security device 20 may comprise one or more than one sensor to sense changes in conditions of the closed object. Sensitive items inside the closed objects may in addition to light need monitoring of integrity of other condition related features, such as change in temperature, acceleration, humidity, pressure, movement and other such features. Therefore, the sensor unit 2 may be equipped with temperature sensor, moisture sensor, pressure sensor and/or accelerator. There may be preconfigured certain threshold values, e.g. temperature range, acceleration range, moisture range, pressure range, to the sensors and the alarm signal is generate in a manner described earlier if these ranges or limits are exceeded or gone below. If needed an A/D converter may be connected between the controller 4 and sensor unit 2. All embodiments described earlier and relating to the light sensor are applicable to other sensors. If the closed object is at least partly broken the sensor unit 2 of the security device 20 inside the closed object may sense a change in temperature, humidity, pressure or movement in the same way as in case of a change in light. According to one embodiment of the invention, the blocks of the security device 20 depicted in FIG. 2 are implemented to a single printed circuit board (PCB) in such a way that there is space for additional sensors to be mounted on the PCB. The security device 20 is arranged to form a single enclosed structure having small size and flat shape, thickness of the device 20 being less than 15 mm.

Environmental conditions for the security device 20 are demanding due to wide range of the practical use of the device 20. For example in transportation conditions may vary a lot depending on the transportation media. The temperature range from −40 to +60 degrees Celsius for the security device 20 is guaranteed. Temperature range for the controller 4 is between −40 and 85 degrees of Celsius. Supply voltage range is between 1.8 and 5.5 volts, and current consumption is very small; in active mode for example from 240 microamperes (1 MHz and 1.8 V) to 15 microamperes (32 kHz and 1.8 V) and in sleep mode 0.1 micro amperes (1.8 V). Therefore, it is sufficient to supply power to the device 20 from a light battery or capacitor. For example, the power of the RF parts can be controlled outside the closed object via RF communication technology.

While this invention has been described with reference to illustrative embodiments, this description is not intended to construe in a limiting sense. Various other embodiments of the invention will be apparent to persons skilled in the art upon reference to this description. It is therefore contemplated that the appended claims will cover any such modifications of the embodiments as fall within the true scope of the invention.

The invention claimed is:

1. A security device for monitoring changes in conditions of a closed object, the device comprising at least one sensor arranged to sense changes in conditions of the closed object in successive time points and arranged to produce an alarm signal upon occurrence of such detected changes exceeding a specified limit value, an indication unit communicating with the sensor, said indication unit comprising at least a transmitter arranged to indicate outside the closed object a presence of said alarm signal by transmitting said alarm signal, wherein said at least one sensor is arranged to switch off said indication unit before indicating the presence of said alarm signal if the changes detected comply with a certain reference condition.

2. The device according to claim 1, wherein the device further comprises a comparing module arranged to compare sensed conditions between successive time points in order to produce the change detected and to compare the change detected with the reference condition.

3. The device according to claim 2, wherein the reference condition is specified to be within a predefined limit value.

4. The device according to claim 1, wherein the device further comprises a comparing module arranged to compare sensed conditions in successive time points with the reference condition.

5. The device according to claim 4, wherein the reference condition is specified not to be within a predefined limit value.

6. The device according to claim 1, wherein the device further comprises a memory arranged to store the sensed condition in successive time points.

7. The device according to claim 6, wherein the memory is arranged to store the reference conditions.

8. The device according to claim 1, wherein the device further comprises a counter arranged to generate a time signal and a certain time interval between successive time points.

9. The device according to claim 1, wherein the indication unit further comprises an input arranged to receive an external command and arranged to activate and deactivate said indicating means in accordance with the external command.

10. The device according to claim 9, wherein the input comprises at least a wireless receiver arranged to receive the external command from an external wireless transmitter and arranged to be activated/deactivated according to said external command.

11. The device according to claim 9, wherein an external radio frequency identification transmitter or a coloured cellular transmitter is arranged to generate the external command to a specified area.

12. The device according to claim 9, wherein said wireless transmitter is arranged to operate in at least two different frequency bands.

13. The device according to claim 1, wherein the indication unit comprises a wireless positioning transmitter arranged to transmit a position information indicating position of producing the alarm signal and/or indicating a position of the security device.

14. The device according to claim 1, wherein the sensor comprises at least one of the following sensors: light sensor, temperature sensor, pressure sensor, motion sensor, humidity sensor and accelerator.

15. A security device for monitoring changes in conditions of a closed object, the device comprising means for sensing changes in conditions of the closed object in successive time points and arranged to produce an alarm signal upon occurrence of such detected changes exceeding a specified limit value, means, communicating with the means for sensing, for indicating outside the closed object a presence of said alarm signal by transmitting said alarm signal, wherein said means for sensing is arranged to switch off said means for selecting before indicating the presence of said alarm signal if the changes detected comply with a certain reference condition.

16. The device according to claim 15, further comprising means for comparing sensed conditions between successive time points in order to produce the change detected and to compare the change detected with the reference condition.

17. The device according to claim 16, wherein the reference condition is specified to be within a predefined limit value.

* * * * *